US005878792A

United States Patent [19]

Pettazzoni et al.

[11] Patent Number: 5,878,792

[45] Date of Patent: Mar. 9, 1999

[54] VAPOR RECOVERY METHOD AND APPARATUS

[76] Inventors: Oliviero Pettazzoni, No. 16 Viale Lincoln, I-40139 Bologna; Germano Bregna, No. 16 Via Nigrisoli, I-40026 Imola (Bologna), both of Italy

[21] Appl. No.: 849,710

[22] PCT Filed: Sep. 30, 1996

[86] PCT No.: PCT/IT96/00182

§ 371 Date: Jun. 3, 1997

§ 102(e) Date: Jun. 3, 1997

[87] PCT Pub. No.: WO97/12833

PCT Pub. Date: Apr. 10, 1997

[30] Foreign Application Priority Data

Oct. 5, 1995 [IT] Italy ..... BO95A0470

[51] Int. Cl.[6] ..... B65B 1/04

[52] U.S. Cl. ..... 141/59; 141/82; 141/45

[58] Field of Search ..... 141/7, 44, 45, 141/59, 290, 82; 62/54.3

[56] References Cited

U.S. PATENT DOCUMENTS

| | | | |
|---|---|---|---|
| 3,756,291 | 9/1973 | McGahey | 141/45 |
| 3,815,327 | 6/1974 | Viland | 141/290 |
| 5,355,915 | 10/1994 | Payne | 141/59 |
| 5,417,256 | 5/1995 | Hartsell, Jr. et al. | 141/59 |

*Primary Examiner*—Steven O. Douglas
*Attorney, Agent, or Firm*—Fay, Sharpe, Beall, Fagan, Minnich & McKee

[57] ABSTRACT

The disclosure relates to a method for collecting gassy residues in fuel filling plants and fuel tanks and apparatus for carrying out the method. The method includes the following phases: removing the residual gases during a refueling phase, subjecting some to a condensation phase (3) up until the gas passes into a liquid stage, bringing the liquid thus produced up to the refueling station or to a collection tank (4).

11 Claims, 1 Drawing Sheet

FIG1
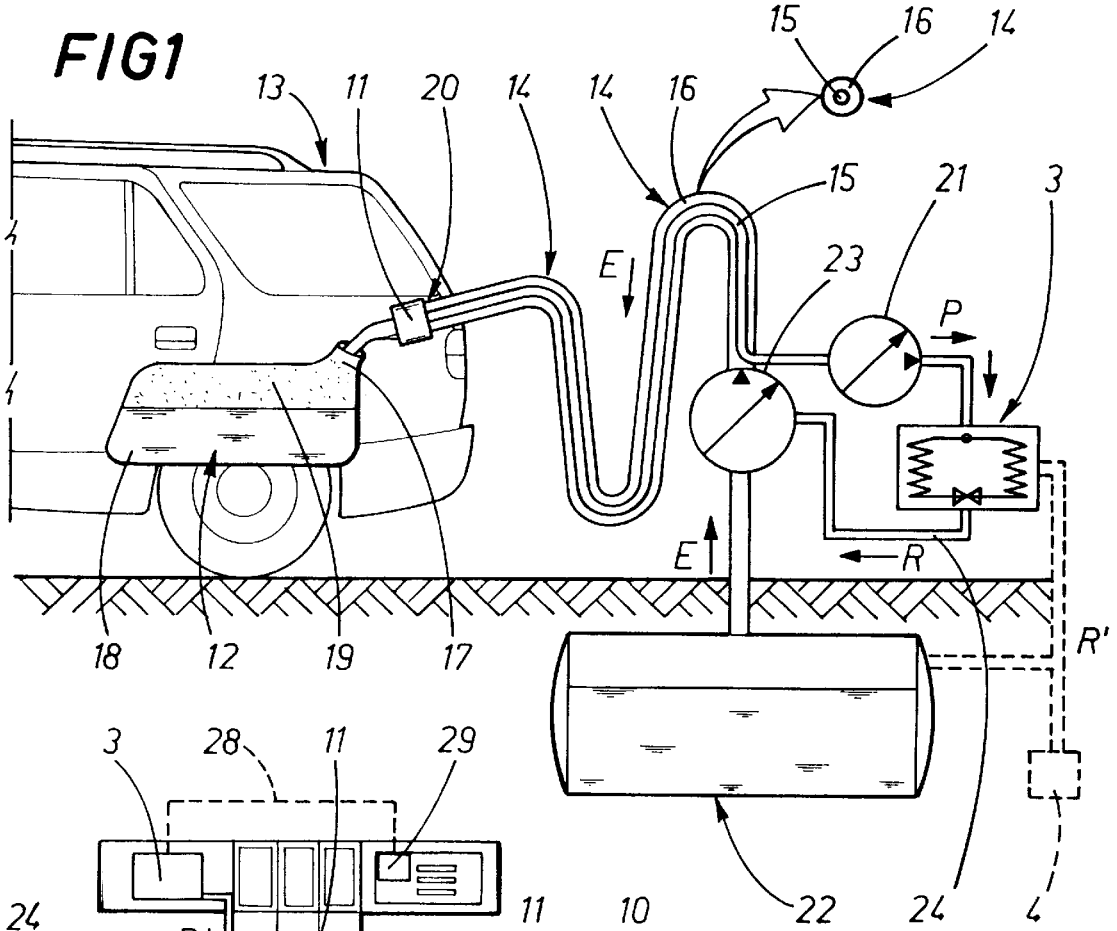
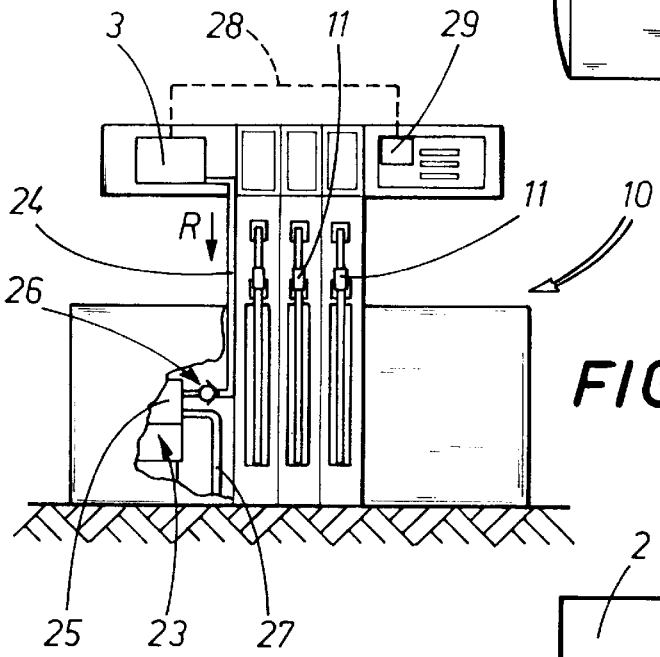
FIG2
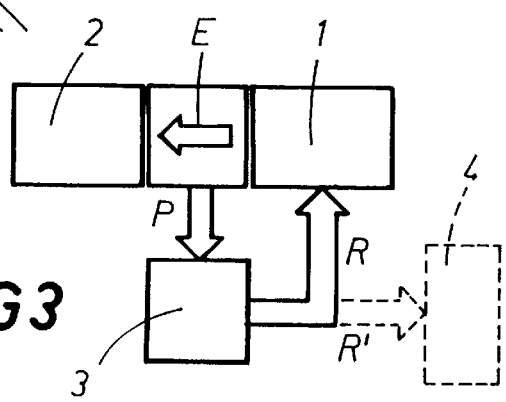
FIG3

VAPOR RECOVERY METHOD AND APPARATUS

BACKGROUND OF THE INVENTION

1. Field of the Invention

The present invention relates generally to a method for collecting residual gases in fuel filling plants and in fuel tanks, and an apparatus therefor. The term tank,is intended to cover both mobile and fixed tanks. More particularly, the present invention relates both to filling operations for vehicles and other thermal engines, and to tanks used for containing fuel in refineries and storage plants, including vehicle fuel carriers and the like.

2. Description of Related Art

During filling operations of liquid fuel such as for example petrol, diesel and the like, a part of the fuel passes from a liquid to a gassy state.

Inhalation of these gases is known to be damaging both to humans and the environment.

For these reasons such gases should advantageously be eliminated or at least limited as much as possible. Legislative steps have been taken which recognize the danger caused by such fumes with regard to operators working in the vicinity thereof, as well as for users and the environment. Indeed, there are already norms in force both in Italy and abroad which attempt to limit or eliminate the above-mentioned emissions in fuel refilling plants.

With reference to the specific case of fuel distribution plants, an attempt at a solution to the problems outlined provides fuel distributors wherein the dispensing pistol is provided with a sort of sucker terminal which achieves a seal between the pistol and the mouth of the filling conduit on the vehicle. The fuel dispensing pipe is coupled coaxially to a second pipe connected to a suction pump, which latter aspirates the gas and discharges same into a conduit leading to the underground fuel tank. This type of process contains at least two drawbacks.

A first of these relates to environmental safeguarding and is connected to the fact that the use of the fuel storage tank for the collection of the gases means that those very gases are released into the environment on each refilling operation of said tank. Thus the gases reach the environment eventually anyway.

A second drawback relates to the expense of the work needed to adapt existing fuel filling plants to this method. For each distributor a gas aspiration pump must be connected up to one of the filling station underground tanks, and these are often situated at a considerable distance from the distributor, leading to extensive excavation, refilling and recovering work.

The problem of gaseous residues is of considerable importance in relation to the transport of fuels and refilling of the tankers in refineries. Indeed, after having emptied their load into fuel station tanks, the tankers are full of residual gases. This in effect means that the same tankers, once empty, represent a real danger of explosion.

From an environmental point of view, a further negative characteristic of the present method of utilization of vehicle fuel tankers is connected with the exchange of fuel between said tanker trucks and the fixed tanks found in refineries (or intermediate fuel storage plants). In this case the gaseous residues are collected in storage tanks and burned off. The resulting candle-like flame is a familiar sight in refineries, but burning off also contributes to enviromental pollution.

Accordingly, it has been considered desirable to develop a new and improved method of recovery gasses which would overcome the foregoing difficulties and others while providing better and more advantageous overall results.

SUMMARY OF THE INVENTION

The aim of the present invention is to eliminate the above-mentioned drawbacks using a method which causes gaseous residues to condense and enable the resulting liquid to be reused or in any case collected without any escape thereof into the environment.

The liquid obtained from the condensation can be collected in a special container tank or, in the specific case of filling stations, can be reintroduced into the dispensing pistol supply circuit, for example at the fuel supply pump.

Reintroduction of the liquid into the pistol supply circuit advantageously enables any need for supplementary tanks and connection conduits to be eliminated.

In the case of tanker trucks, the liquid obtained from condensation can preferably be collected in collection tanks, situated at the fuel filling stations or refineries.

The condensation can be effected in various ways: one preferable way is to cool the gassy residues down to a temperature which liquifies them. Other methods might employ pressurization or chemical processes which lead to liquification.

A cooling method, as mentioned above, can be constituted by a refrigeration unit associated to an aspiration pump for the gas residues, in the case-of fuel filling stations the unit being connected to the fuel supply pump. In this way, the gassy residues aspirated by the pump are condensed by the refrigeration unit and the liquid thus obtained is reintroduced into the fuel filling circuit through the supply pump, for example through the conduit leading to the air separator chamber of the pump.

One advantage of the present invention is the provision of reintroduction of liquid into the pistol supply circuit which eliminates the need for supplementing collection tabs and connection circuits.

Still other benefits and advantages of the present invention will become apparent to those skilled in the art upon a reading and understanding of the following detailed specification.

The technical characteristics of the invention emerge clearly from the appended claims, and the advantages of the invention will better emerge from the detailed description that follows, made with reference to the accompanying drawings, which represent a non-limiting embodiment of the invention herein described purely by way of example.

BRIEF DESCRIPTION OF THE DRAWINGS

FIG. 1 is a schematic view, with parts in different scale and represented by blocks, of a possible embodiment of the invention, relating specifically to application thereof in a fuel filling station;

FIG. 2 is a schematic front view, with some parts removed and others represented by blocks, of a possible embodiment of a fuel distributor made according to the present invention;

FIG. 3 is a block diagram relating to the carrying out of the method of the invention.

DETAILED DESCRIPTION OF THE PREFERRED EMBODIMENTS

With reference to the figures of the drawings, and in particular to the diagram of FIG. 3, the method for the collection of gassy residues in refuelling plants and in fuel tanks includes the following phases.

First the gassy residues are removed during the fuel dispensing phase.

The fuel dispensing, for example, might be a refuelling of a motor vehicle at a fuel filling station, or by the filling-up of a tanker truck at a refinery or fuel storage plant, or by the unloading of fuel from a tanker truck into a fuel filling station. The reference made above to the dispensing phase refers specifically to any operations connected with the dispensing of the fuel, including the collection of gassy residues contained in a fixed or mobile tank used for containing fuel.

In FIG. 3 block 1 represents the "source" of dispensing while block 2 indicates the "destination" of the fuel and E represents a possible dispensing path.

The phase indicated using the letter P involves the removal of the gassy residues of the fuel, which can be performed at the same time as the filling operation, as in the case of a motor vehicle in a filling station, or can be carried out subsequently, as in the case of gassy residues from a fixed or mobile tank.

The subsequent phase involves condensing, using special means represented by block 3, the gassy residues up until they pass into the liquid state.

Condensation can be performed, as mentioned above, in various ways. One possible procedure is to cool the gassy residues by means of a refrigeration unit, up until a liquid is obtained.

The liquid obtained thus is then reintroduced into the fuel dispensing circuit (by sending same to source 1), as shown by path R of FIG. 1, or, as indicated by arrow R' (in a broken line) sent to a special collection tank 4 (also shown in a broken line).

In the specific case of fuel distributors, illustrated in FIGS. 1 and 2, the method can include introduction of the liquid obtained (which is the same as the fuel dispensed from the distributor) into the fuel supply circuit at the supply pump.

FIGS. 1 and 2 are a schematic representation of a fuel distributor 10. The distributor 10 is provided with at least one dispensing pistol 11, for connecting with a mouth 17 of a car 13 fuel tank 12.

The dispensing pistol 11 is situated at the free end of a double-conduit pipe 14. One of the two conduits in the pipe 14, the one indicated by 16 in FIG. 1, which is coaxial to and external of the other conduit 15, dispenses the fuel in a direction indicated by E. The remaining conduit 15 connects an end 20 of the pipe 14, which end 20 is sealedly associable to the mouth 17, to an aspiration pump 21. The fuel contained in a tank 22 is sent by a supply pump 23 (in direction E) along the conduit 16 of the pipe 14 to fill the fuel tank 12. The gassy residues denoted by 19, which fill the tank 12 area remaining above the fuel level 18, are aspirated along the communication holes 15 and sent by the pump 21 in direction P, towards the means for condensing 3.

The liquid obtained by action of the means for condensing 3 can be sent to a collection tank 4 (along the path R', the tank 4 and path R' being represented in broken lines in FIG. 1) or reintroduced into the fuel supply circuit, at the supply pump 23, for example by means of a conduit 24.

The conduit 24, which represents the means for connecting the means for condensing 3 to the fuel supply pump 23, can be associated to an air separator chamber 25 of the supply pump 23 with a single-acting valve 26 connected to the discharge pipe 27 of the separator chamber 25, as illustrated in FIG. 2.

The apparatus can be associated, with a connection represented by 28 in a broken line in FIG. 2, to the control panel 29 of the fuel distributor 10. In this way, at least the aspiration pump 23 and the means for condensing 3 are activatable by activation of the dispensing pistol 11. The means for condensing 3 can advantageously be arranged in a zone above the distributor 10, so as to enable the liquid obtained to drop into the supply pump 23.

In the case of gassy residue collection in a fixed or mobile tank (such as for example in cases concerning tanker truck-filling station tank or refinery-tanker truck transfer), the apparatus will comprise at least: an aspiration pump for the gassy residues connected to a tank access aperture; means for condensing the gassy residues, producing a liquid and means for associating the liquid thus obtained with a collection tank.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof.

We claim:

1. A method for collecting gassy residues in fuel filling plants or fuel tanks, the plants including at least a fuel supply circuit and a fuel supply pump, the method comprising the following steps:

collecting the gassy residues from a fuel tank during a fuel dispensing step;

condensing said gassy residues up until said residues are completely transformed into a liquid state by means of cooling, said cooling being obtained by a refrigeration unit; and, reintroducing the resulting liquid obtained by the condensation step into the fuel supply circuit at a fuel supply pump.

2. A method as in claim 1, wherein the fuel supply pump which is provided of an air separator chamber and the resulting liquid is reintroduced into the fuel supply circuit at the air separator chamber of the fuel pump.

3. A method for collecting gassy residues in fuel filling plants or fuel tanks, the plants including at least a fuel supply circuit and a fuel supply pump, the method comprising the following steps:

refueling a fuel tank, which is at least partially empty of fuel and is at least partially full of gassy residues of the fuel;

removing the gassy residues from the fuel tank during a fuel dispensing step;

cooling said gassy residues up until said residues are completely transformed into a liquid state; and, while refueling the fuel tank, reintroducing the resulting liquid obtained by the condensation step into the fuel supply circuit at the fuel supply pump.

4. A method for collecting gassy residues in fuel filling plants or fuel tanks, the plants including at least a fuel supply circuit, a fuel supply pump and a collection tank, the method comprising the following steps:

refueling a fuel tank, which is at least partially empty of fuel and at least partially full of gassy residues of the fuel;

removing the gassy residues from the fuel tank during a fuel dispensing step;

cooling said gassy residues up until said residues are completely transformed into a liquid state; and, introducing the resulting liquid obtained by the condensation step into the collection tank.

5. An apparatus for collecting gassy residues in fuel filling plants or fuel tanks, the plants including at least a fuel supply circuit and a fuel supply pump, comprising:

a pistol for dispensing fuel to a fuel tank through an entry manifold of said fuel tank, the pistol having at least a first conduit for dispensing the fuel and a second conduit for removing gassy residues which are into said fuel tank;

a pump for aspirating said gassy residues, the pump being connected to the second conduit of the fuel dispensing pistol;

means for cooling the gassy residues up to complete condensation, the cooling means being connected to the aspirating pump; and, means for associating the condensed residues with the fuel dispensed by the pistol, the associating means being connected with the cooling means.

6. An apparatus as in claim 5, wherein the cooling means comprise a refrigeration unit provided with at least a cooling coil about which the gassy residues flow.

7. An apparatus as in claim 5, wherein the associating means comprise means for connecting the cooling means with the fuel supply pump.

8. An apparatus as in claim 7, wherein the fuel supply pump comprises an air separator chamber and the connecting means comprise a conduit arranged between the cooling means and the air separator chamber of the fuel supply pump.

9. An apparatus as in claim 5 further comprising an electrical means for control, acting on at least said gassy residues aspiration pump and said cooling means, which means for control are associated to a control panel of a fuel distributor.

10. An apparatus for collecting gassy residues in a fixed or mobile fuel tank, comprising:

a pump for aspirating the gassy residues, the pump being connected to an access aperture of a fuel tank;

means for cooling the gassy residues up to complete condensation, the cooling means being connected to the aspirating pump;

a collection tank connected to the cooling means; and, means for reintroducing the condensed residues in the collection tank.

11. An apparatus for collecting gassy residues in a fixed or mobile fuel tank, comprising:

a pump for aspirating the gassy residues, the pump being connected to an access aperture of a fuel tank;

means for cooling the gassy residues up to complete condensation, the cooling means being connected to the aspirating pump; and, means for reintroducing the condensed residues in the fuel tank.

* * * * *